US009400094B2

(12) United States Patent
Wakahara et al.

(10) Patent No.: US 9,400,094 B2
(45) Date of Patent: Jul. 26, 2016

(54) LIGHTING APPARATUS

(75) Inventors: Junya Wakahara, Settsu (JP); Nobuya Miki, Ibaraki (JP); Naoki Masazumi, Kobe (JP); Yasuhiro Honda, Ibaraki (JP)

(73) Assignee: KONICA MINOLTA, INC., Tokyo (JP)

( * ) Notice: Subject to any disclaimer, the term of this patent is extended or adjusted under 35 U.S.C. 154(b) by 25 days.

(21) Appl. No.: 14/344,520

(22) PCT Filed: Sep. 4, 2012

(86) PCT No.: PCT/JP2012/072424
§ 371 (c)(1),
(2), (4) Date: Mar. 12, 2014

(87) PCT Pub. No.: WO2013/038947
PCT Pub. Date: Mar. 21, 2013

(65) Prior Publication Data

US 2014/0347857 A1 Nov. 27, 2014

(30) Foreign Application Priority Data

Sep. 15, 2011 (JP) ..... 2011-201520

(51) Int. Cl.
*F21S 2/00* (2016.01)
*F21V 21/14* (2006.01)
(Continued)

(52) U.S. Cl.
CPC . *F21V 21/14* (2013.01); *F21S 2/00* (2013.01); *F21V 19/02* (2013.01); *F21V 21/02* (2013.01);
(Continued)

(58) Field of Classification Search
CPC ..... F21S 2/00; F21V 19/005; F21V 21/02; F21V 21/088; F21V 19/002; F21V 13/08; F21K 9/30; F21K 9/56; F21K 9/50; H01L 25/0753; H01L 2224/16225; H01L 2224/48137; H01L 2224/48091; H01L 2924/19107; H01L 33/60
USPC ..... 362/249.11
See application file for complete search history.

(56) References Cited

U.S. PATENT DOCUMENTS 7,121,688 B2 * 10/2006 Rempel ..... 362/249.11
7,175,296 B2 * 2/2007 Cok ..... 362/147
(Continued)

FOREIGN PATENT DOCUMENTS

JP 2006-236877 A 9/2006
JP 2006236877 A 9/2006
(Continued)

OTHER PUBLICATIONS

International Search Report for International Application No. PCT/JP2012/072424, dated Nov. 20, 2012, with English translation.
(Continued)

*Primary Examiner* — Sharon Payne
(74) *Attorney, Agent, or Firm* — Cantor Colburn LLP

(57) ABSTRACT

A lighting apparatus may include a holding member, a lighting panel, and an attachment bracket for removably attaching the lighting panel to the holding member. The lighting panel may form a first position in which a light-emitting surface of the lighting panel and a light-emitting surface of a lighting panel are located substantially on the same plane with each other and a second position in which the lighting panel is pressed from its light-emitting surface side so that the attachment bracket pivots around a portion where the attachment bracket is attached to the holding member and the lighting panel is inclined with respect to the lighting panel. As the lighting panel forming the second position is moved in a direction away from the holding member the attachment bracket is released from the holding member, and the lighting panel forming the second position is readily removed from the holding member.

11 Claims, 9 Drawing Sheets

(51) Int. Cl.

| | |
|---|---|
| ***F21V 19/02*** | (2006.01) |
| ***F21V 21/30*** | (2006.01) |
| ***F21V 21/02*** | (2006.01) |
| ***F21V 21/088*** | (2006.01) |
| *F21Y 105/00* | (2016.01) |
| *F21V 19/00* | (2006.01) |

(52) U.S. Cl.
CPC ..... *F21V 21/088* (2013.01); *F21V 21/30* (2013.01); *F21V 19/004* (2013.01); *F21Y 2105/008* (2013.01)

(56) References Cited

U.S. PATENT DOCUMENTS

| | | | | |
|---|---|---|---|---|
| 7,246,918 | B2 * | 7/2007 | Ginsburg | 362/249.11 |
| 2001/0053076 | A1 * | 12/2001 | Chien | 362/84 |
| 2009/0096362 | A1 | 4/2009 | Diekmann et al. | |

FOREIGN PATENT DOCUMENTS

| | | | |
|---|---|---|---|
| JP | 2007-172919 | A | 7/2007 |
| JP | 2007-250302 | A | 9/2007 |
| JP | 2010-9886 | A | 1/2010 |
| JP | 2010009886 | A | 1/2010 |

OTHER PUBLICATIONS

Extended European Search Report corresponding to Application No. 12830978.8-1757/2757311, PCT/JP2012/072424; Date of Mailing: Mar. 30, 2015.
European Office Action corresponding to Application No. 12830978.8-1757; Date of Mailing: Feb. 18, 2016.

* cited by examiner

LIGHTING APPARATUS

This is the U.S. national stage of application No. PCT/JP2012/072424, filed on 4 Sep. 2012. Priority under 35 U.S.C. §119(a) and 35 U.S.C. §365(b) is claimed from Japanese Application No. 2011-201520, filed 15 Sep. 2011, the disclosure of which is also incorporated herein by reference.

TECHNICAL FIELD

The present invention relates to a lighting apparatus and particularly to a lighting apparatus including a removable lighting panel.

BACKGROUND ART

As disclosed in Japanese Laid-Open Patent Publication No. 2007-172919 (PTD 1), a lighting apparatus including a removable lighting panel has been known. In such a lighting apparatus, a lighting panel is removably attached to a holding member fixed to a ceiling, a wall surface, or the like. The lighting panel is arranged at a prescribed position and emits light by being driven in that state.

CITATION LIST

Patent Document

PTD 1: Japanese Laid-Open Patent Publication No. 2007-172919

SUMMARY OF INVENTION

Technical Problem

As described above, the lighting panel emits light by being driven while it is arranged at a prescribed position. The lighting panel may be arranged such that its outer periphery is surrounded by other lighting panels, a wall surface, a ceiling surface, or the like. For example, it is assumed that a plurality of lighting panels are arranged in matrix and light-emitting surfaces are arranged to be adjacent on the same plane. In a case that a lighting panel and other lighting panels adjacent to this lighting panel are in intimate contact or a case that a gap between lighting panels is small although contact is not intimate (hereinafter these states will collectively be referred to as "adjacent"), it is difficult to insert a finger, a tool, or the like into a gap, and attachment and removal of the lighting panel is difficult.

It is an object of the present invention is to provide a lighting apparatus allowing easy attachment and removal of a lighting panel even though an outer periphery of the lighting panel is arranged to be surrounded by other lighting panels, a wall surface, a ceiling surface, or the like substantially without a space.

Solution to Problem

A lighting apparatus based on one aspect of the present invention includes a holding member having a shape extending in a prescribed direction, a lighting panel attached to the holding member and provided with a light-emitting surface on a side of a front surface, and an attachment bracket provided on a back surface of the lighting panel, for removably attaching the lighting panel to the holding member, the light-emitting surface of the lighting panel is arranged to be adjacent to a light-emitting surface of another lighting panel, the lighting panel forms a first position in which the light-emitting surface of the lighting panel and the light-emitting surface of another lighting panel are located substantially on the same plane with each other and a second position in which the lighting panel is pressed from a side of the light-emitting surface of the lighting panel so that the attachment bracket pivots around a portion where the attachment bracket is attached to the holding member and the lighting panel is inclined with respect to another lighting panel, and the attachment bracket is released from the holding member and the lighting panel forming the second position is removed from the holding member as the lighting panel forming the second position is moved in a direction away from the holding member.

A lighting apparatus based on another aspect of the present invention includes a lighting panel provided with a light-emitting surface on a side of a front surface and an attachment bracket provided on a back surface of the lighting panel, for removably attaching the lighting panel to a holding member fixed to an installation location of the lighting panel and having a shape extending in a prescribed direction, the light-emitting surface of the lighting panel is arranged to be adjacent to a light-emitting surface of another lighting panel, the lighting panel forms a first position in which the light-emitting surface of the lighting panel and the light-emitting surface of another lighting panel are located substantially on the same plane with each other and a second position in which the lighting panel is pressed from a side of the light-emitting surface of the lighting panel so that the attachment bracket pivots around a portion where the attachment bracket is attached to the holding member and the lighting panel is inclined with respect to another lighting panel, and the attachment bracket is released from the holding member and the lighting panel forming the second position is removed from the holding member as the lighting panel forming the second position is moved in a direction away from the holding member.

Advantageous Effects of Invention

According to the present invention, a lighting apparatus allowing easy attachment and removal of a lighting panel even though an outer periphery of the lighting panel is arranged to be surrounded by other lighting panels, a wall surface, a ceiling surface, or the like substantially without a space can be obtained.

DESCRIPTION OF EMBODIMENTS

Figure 1:
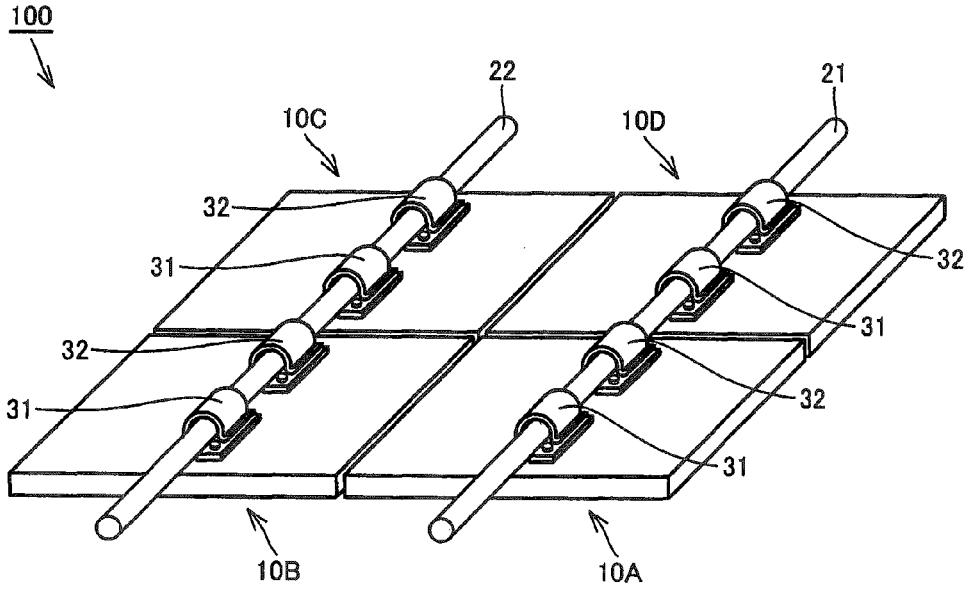
FIG. 1 is a perspective view showing a lighting apparatus in a first embodiment.

Each embodiment based on the present invention will be described hereinafter with reference to the drawings. When the number, an amount or the like is mentioned in the description of each embodiment, the scope of the present invention is not necessarily limited to the number, the amount or the like, unless otherwise specified. In the description of each embodiment, the same or corresponding elements have the same reference characters allotted and redundant description may not be repeated.

[First Embodiment]

(Lighting Apparatus 100)

A lighting apparatus 100 in the present embodiment will be described with reference to FIG. 1. FIG. 1 is a perspective view showing lighting apparatus 100 (a diagram when lighting apparatus 100 is viewed from a back surface side opposite to a light-emitting surface of each of lighting panels 10A to 10D). Lighting apparatus 100 includes lighting panels 10A to 10D, holding members 21, 22, and attachment brackets 31, 32.

Figure 3:
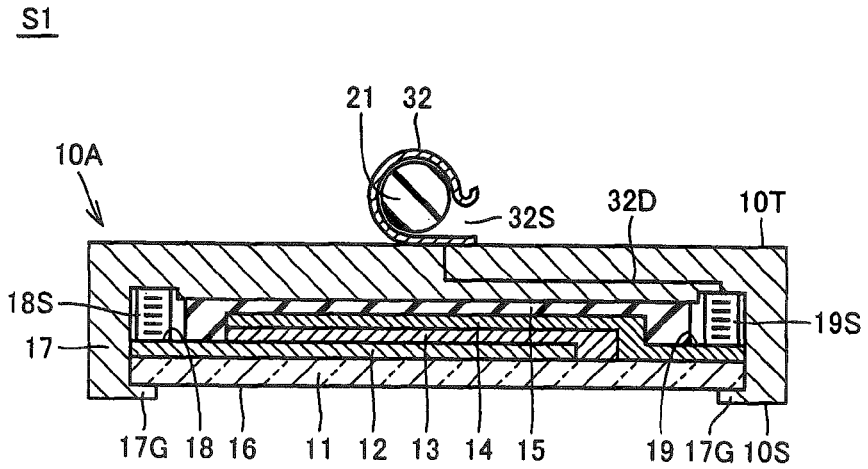
FIG. 3 is a cross-sectional view along the arrow line II-II in FIG. 2.

Lighting panels 10A to 10D each have a light-emitting surface on a front surface side (see a light-emitting surface 16 in FIG. 3). Two attachment brackets 31, 32 are attached onto a back surface of each of lighting panels 10A to 10D. Holding member 21, 22 is formed from a columnar member extending in a prescribed direction.

Holding member 21, 22 is fixed to a ceiling, a wall surface (both of which are not shown), or the like, by a shaft-receiving member (not shown). Holding members 21, 22 in the present embodiment are arranged to satisfy positional relation in parallel to each other. Holding member 21, 22 is not limited to a columnar member, and it may be formed from a member having a polygonal cross-sectional shape.

Lighting panel 10A and lighting panel 10D next to each other are aligned along a direction of extension of holding member 21. Lighting panel 10A and lighting panel 10D are removably attached to holding member 21 by using attachment brackets 31, 32 (details will be described later).

Lighting panel 10B and lighting panel 10C next to each other are aligned along a direction of extension of holding member 22. Lighting panel 10B and lighting panel 10C are removably attached to holding member 22 by using attachment brackets 31, 32 (details will be described later).

In a state that lighting panels 10A to 10D are attached to holding members 21, 22, light-emitting surfaces (see light-emitting surface 16 in FIG. 3) of lighting panels 10A to 10D are adjacent to one another. Lighting panels 10A to 10D in the present embodiment are arranged to be in intimate contact with one another. The light-emitting surfaces (see light-emitting surface 16 in FIG. 3) of lighting panels 10A to 10D are located substantially on the same plane with one another.

(Lighting Panel 10A)

Lighting panel 10A will be described hereinafter with reference to FIGS. 2 and 3. Lighting panels 10B to 10D are constructed similarly to lighting panel 10A. Description of lighting panels 10B to 10D will not be repeated.

Figure 2:
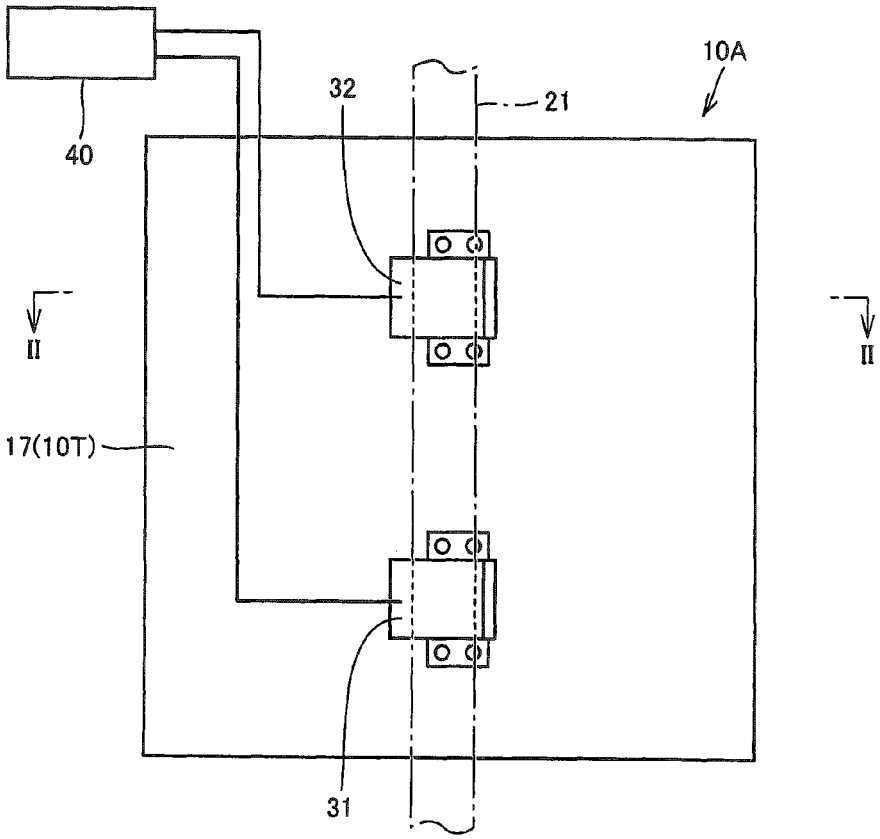
FIG. 2 is a plan view showing a back surface side of a lighting panel provided in the lighting apparatus in the first embodiment.

FIG. 2 is a plan view showing a back surface 10T side of lighting panel 10A. As shown in FIG. 2, outer geometry of lighting panel 10A in a plan view is formed to be rectangular. Lighting panel 10A is arranged such that its outer periphery is surrounded by lighting panel 10B (see FIG. 1), lighting panel 10D (see FIG. 1), and other members such as a ceiling surface or a wall surface (not shown) substantially without a space.

As described above, lighting panels 10B, 10D are constructed similarly to lighting panel 10A. Lighting panel 10A may be arranged such that the entire outer periphery is surrounded by other lighting panels (such as lighting panels 10B, 10D) constructed similarly to lighting panel 10A.

FIG. 3 is a cross-sectional view along the arrow line II-II in FIG. 2. As shown in FIG. 3, lighting panel 10A is light emission means including organic EL (Organic Electroluminescence). Lighting panel 10A includes a transparent substrate 11 (a cover layer), an anode 12, an organic layer 13, a cathode 14, a sealing layer 15, light-emitting surface 16, and a housing 17. Anode 12, organic layer 13, and cathode 14 are successively stacked on a front surface of transparent substrate 11.

Transparent substrate 11 is formed, for example, from various glass substrates. For a member constructing transparent substrate 11, a film substrate, for example, of PET (Polyethylene Terephthalate) or polycarbonate may be employed. Light-emitting surface 16 is formed on a lower surface of transparent substrate 11 (on a side of a front surface 10S of lighting panel 10A).

Anode 12 is a conductive film having transparency. In order to form anode 12, a film of ITO (Indium Tin Oxide) or the like is formed on transparent substrate 11 through sputtering or the like. An ITO film is patterned to a prescribed shape through photolithography or the like, so that anode 12 is formed.

Organic layer 13 can generate light (visible light) as it is supplied with electric power. Organic layer 13 may be formed from a single light-emitting layer, or may be formed by successively stacking a hole transport layer, a light-emitting layer, a hole block layer, an electron transport layer, and the like.

Cathode 14 is made, for example, of aluminum (AL). Cathode 14 is formed to cover organic layer 13 through vacuum vapor deposition or the like. In order to pattern cathode 14 to a prescribed shape, a mask is desirably used during vacuum vapor deposition.

Sealing layer 15 has an isolation property. Sealing layer 15 is formed to protect organic layer 13 against moisture or the like. Sealing layer 15 is formed, for example, by using a glass substrate and adhering a periphery with an epoxy-based photo-curable adhesive.

Sealing layer 15 seals anode 12, organic layer 13, and cathode 14 substantially in the entirety on transparent substrate 11. A part of anode 12 and a part of cathode 14 are exposed through sealing layer 15 for electrical connection. The part of anode 12 exposed through sealing layer 15 implements an anode connection portion 18. The part of cathode 14 exposed through sealing layer 15 implements a cathode connection portion 19.

Anode connection portion 18 is electrically connected to attachment bracket 31 (see FIG. 2) through a contact spring 18S and an internal wiring material (not shown). Attachment bracket 31 is formed from a member made of metal and connected to a drive circuit 40 (see FIG. 2) (external electric power supply means) for power feeding to lighting panel 10A. Attachment bracket 31 forms an electric contact for an anode for power feeding from drive circuit 40 to lighting panel 10A.

Cathode connection portion 19 is electrically connected to attachment bracket 32 through a contact spring 19S and an internal wiring material 32D. Attachment bracket 32 is also formed from a member made of metal and connected to drive circuit 40 (see FIG. 2) (external electric power supply means) for power feeding to lighting panel 10A. Attachment bracket 32 forms an electric contact for a cathode for power feeding from drive circuit 40 to lighting panel 10A.

In lighting panel 10A, an AC voltage is applied across anode 12 and cathode 14 by drive circuit 40. As an AC voltage is applied, organic layer 13 emits light. Light generated in organic layer 13 is extracted to the outside from a transparent substrate 11 (light-emitting surface 16) side.

As shown in FIG. 3, transparent substrate 11, anode 12, organic layer 13, cathode 14, and sealing layer 15 are arranged within housing 17. Housing 17 has an extension portion 17G extending from an end portion toward a central portion, on the light-emitting surface 16 side. Extension portion 17G fixes transparent substrate 11, anode 12, organic layer 13, cathode 14, and sealing layer 15 within housing 17.

Vertical and lateral lengths of light-emitting surface 16 are, for example, from 10 cm to 30 cm, whereas a width of extension portion 17G is desirably formed to be smaller, for example, approximately from 5 mm to 10 mm. In order to arrange anode 12, organic layer 13, cathode 14, and sealing layer 15 within housing 17, a portion of housing 17 on the back surface 10T side may be formed as a separate member like a lid.

(Attachment Bracket 31, 32)

As described above, attachment brackets 31, 32 are provided as being aligned at a distance from each other, on an upper surface of housing 17 (back surface 10T of lighting panel 10A). Attachment brackets 31, 32 in the present embodiment are constructed similarly to each other. Attachment bracket 32 alone will be described hereinafter.

As shown in FIGS. 1 to 3, attachment bracket 32 is formed substantially in a cylindrical shape as a whole and a part of an outer circumferential surface is discontinuous along a direction of an axis of the cylinder. In other words, attachment bracket 32 has a cross-sectional shape formed substantially in a C-shape. In a portion where a part of attachment bracket 32 is discontinuous, a reception portion 32S for receiving holding member 21 (see FIG. 3) is formed.

Attachment bracket 32 has prescribed elasticity, and it is formed, for example, from a member made of metal such as SUS (stainless steel). Attachment bracket 32 has one side screwed onto housing 17 of lighting panel 10A, with reception portion 32S lying between one side and the other side (see FIG. 2). The other side of attachment bracket 32 forms a leaf spring curved in an arc shape, with reception portion 32S lying between one side and the other side. Attachment bracket 32 may be fixed onto housing 17 of lighting panel 10A by other mechanical fastening means such as caulking.

Holding member 21 is removably fitted into and attached to attachment bracket 32 through reception portion 32S. In addition, holding member 21 attached to attachment bracket 32 is pulled out of attachment bracket 32 similarly through reception portion 32S and released from attachment bracket 32. When holding member 21 is fitted to attachment bracket 32 and when holding member 21 is pulled out of attachment bracket 32, reception portion 32S and the portion forming the leaf spring curved in the arc shape above are made use of A similar feature is present also in attachment bracket 31, although it is not shown.

When lighting panel 10A is attached to holding member 21, reception portion 32S is pressed against holding member 21, so that opposing end portions of reception portion 32S spread as a result of an action of the leaf spring of attachment bracket 32 to thereby allow passage of holding member 21. After holding member 21 passed reception portion 32S, attachment bracket 32 elastically deforms so as to surround the outer circumference of holding member 21 (that is, to return to an original state) and attachment bracket 32 and holding member 21 are engaged with each other to thereby attach holding member 21 to attachment bracket 32. When lighting panel 10A is removed from holding member 21, attachment bracket 32 elastically deforms so as to spread with the reception portion (reception portion 32S) being defined as the center, attachment bracket 32 and holding member 21 are disengaged from each other, and holding member 21 is released from attachment bracket 32. Attachment bracket 31 and holding member 21 are also similarly attached to and released from each other.

(Operation of Lighting Apparatus 100)

FIG. 3 illustrates lighting panel 10A at the time when light-emitting surface 16 of lighting panel 10A and light-emitting surfaces 16 of lighting panels 10B to 10D (see FIG. 1) are located on the same plane with one another. This position of lighting panel 10A is referred to as a first position S1 in the present invention. Lighting panel 10A emits light by being driven by drive circuit 40 (see FIG. 2) while it forms first position S1.

In lighting apparatus 100, in order to obtain what is called a narrow frame structure, light-emitting surfaces are arranged next to one another on the same plane and lighting panels 10A to 10D are arranged to be adjacent to one another. While lighting panel 10A forms first position S1, a gap between lighting panel 10A and lighting panel 10B, 10D, or the like is extremely small.

Here, it is assumed that lighting panel 10A in lighting apparatus 100 should be replaced. In this case, a portion around an outer peripheral portion of lighting panel 10A forming first position S1 on the light-emitting surface 16 side is pressed (see an arrow DR in FIG. 4). Here, housing 17 is preferably made use of for pressing lighting panel 10A. In addition, for safety, preferably, power feeding to lighting panels 10A to 10D is stopped.

Figure 4:
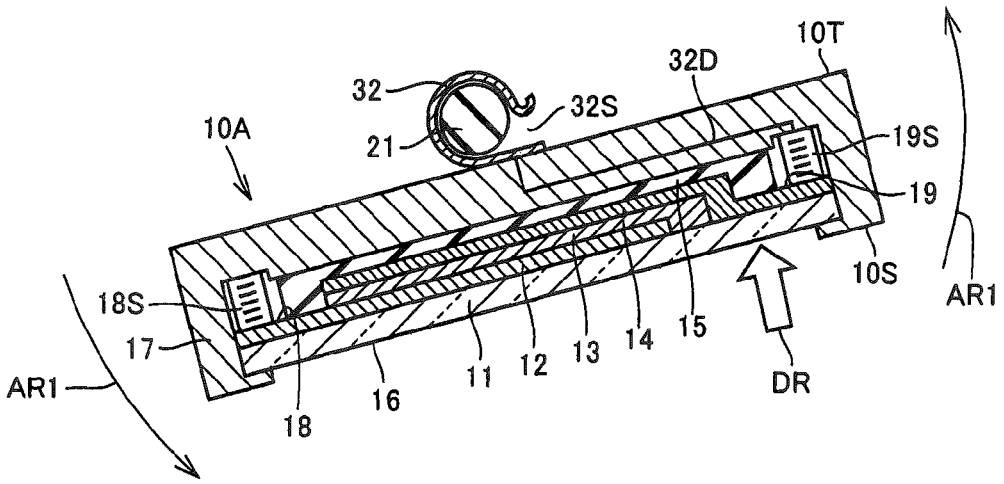
FIG. 4 is a cross-sectional view showing a manner that the lighting panel and an attachment bracket provided in the lighting apparatus in the first embodiment are removed from a holding member.

Referring to FIG. 4, lighting panel 10A pivots in a direction shown with an arrow AR1 with a portion of attachment bracket 31, 32 engaged with holding member 21 serving as the center, as the portion around the outer peripheral portion is pressed. Reception portion 32S of attachment bracket 32 (and the reception portion of attachment bracket 31) also rotates by an amount comparable to an angle of rotation of lighting panel 10A. Lighting panel 10A forms a second position S2 inclined with respect to other lighting panels 10B, 10D (see FIG. 5) and the like (in an inclined state).

Figure 5:
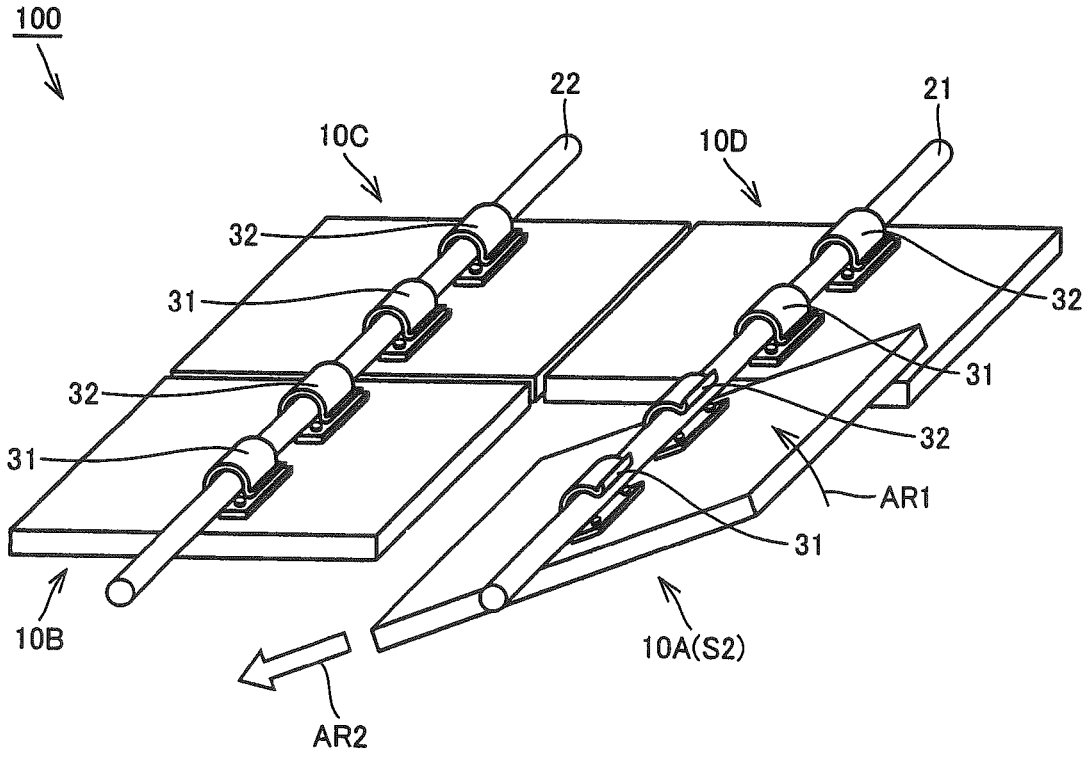
FIG. 5 is a perspective view showing the manner that the lighting panel and the attachment bracket provided in the lighting apparatus in the first embodiment are removed from the holding member.

As shown in FIG. 5, lighting panel 10A forming second position S2 is moved (slide movement) by making use of reception portion 32S (see FIG. 4), such that it is pulled out in a direction away from holding member 21 (see an arrow AR2). Here, as shown in FIG. 5, while lighting panel 10A forms second position S2, reception portion 32S of attachment bracket 32 (see FIG. 4) is located exactly opposite to a direction in which lighting panel 10A and attachment bracket 31, 32 are moved away from holding member 21 (the direction shown with arrow AR2). This is also applicable to attachment bracket 31.

As lighting panel 10A and attachment brackets 31, 32 move, attachment brackets 31, 32 and holding member 21 are disengaged from each other, and lighting panel 10A and attachment brackets 31, 32 are removed from holding member 21. Lighting panel 10A is replaced with a new one. When a new lighting panel is attached to holding member 21, operations in a flow reverse to the above are performed.

A new lighting panel is attached to holding member 21 while it forms second position S2, and thereafter a portion around the outer peripheral portion of lighting panel 10A is pressed. The new lighting panel is pivoted such that the light-emitting surface thereof is located to be on the same plane with light-emitting surfaces 16 of other lighting panels 10B to 10D The new lighting panel forms first position S1 during light emission, and the light-emitting surface thereof is substantially on the same plane with those of other lighting panels 10B to 10D.

(Function and Effect)

Lighting panel 10A readily makes transition from first position S1 to second position S2 as a portion around the outer peripheral portion is pressed. Lighting panel 10A is surrounded by other lighting panels 10B, 10D or the like while it forms first position S1, and it can emit light similarly to lighting panels 10B to 10D. Therefore, lighting apparatus 100 can efficiently and evenly illuminate by means of a plurality of lighting panels 10A to 10D arranged to be intimate contact with one another without any space.

On the other hand, while lighting panel 10A forms second position S2, by making use of the reception portion (reception portion 32S) of attachment bracket 31, 32, lighting panel 10A can readily be removed from holding member 21. According to lighting apparatus 100 including lighting panel 10A, even though lighting panel 10A is arranged such that the outer periphery of lighting panel 10A is surrounded by other lighting panels, a wall surface, a ceiling surface, or the like substantially without a space, that lighting panel 10A can readily be replaced.

In lighting apparatus 100, in order to replace lighting panel 10A, it is not necessary to provide a hook portion on lighting panel 10 or to provide a cut portion in lighting panel 10A. Since no hook portion or cut portion is provided, a non-light-emitting portion on lighting panel 10A does not become large or no illumination unevenness attributed to the non-light-emitting portion takes place. Therefore, according to lighting apparatus 100 including lighting panel 10A in the present embodiment, not only convenience in replacement of lighting panel 10A can be improved but also light emission efficiency can be improved, and furthermore, occurrence of illumination unevenness can also be suppressed. Moreover, since no protrusion is present in an outer periphery of lighting panel 10A, a plurality of lighting panels can be arranged in intimate contact with one another, and a large light emission surface can be realized by paving a plurality of lighting panels.

Though description has been given in the present embodiment based on a form that lighting apparatus 100 is attached to a ceiling, the same function and effect can be obtained also in a case that lighting apparatus 100 is attached to a wall surface. Lighting apparatus 100 can be installed in any space in which holding member 21 can be fixed. In lighting apparatus 100, lighting panel 10A and lighting panels 10B to 10D are similarly constructed. Therefore, in lighting apparatus 100, not only in lighting panel 10A, a function and effect the same as that in lighting panel 10A can be obtained also in lighting panels 10B to 10D.

In addition to lighting panels 10A to 10D, lighting apparatus 100 may further include a plurality of lighting panels constructed similarly to these. As each lighting panel makes transition from first position S1 to second position S2 similarly to lighting panel 10A, each lighting panel can readily be replaced.

In the present embodiment, two attachment brackets 31, 32 in total are provided for one lighting panel 10A. In lighting panel 10A, any one of attachment bracket 31 and attachment bracket 32 may be provided, or a plurality of other attachment brackets in addition to attachment bracket 31 and attachment bracket 32 may be provided. In lighting panels 10A to 10D in the present embodiment, one organic EL panel is internally provided for one housing 17. A plurality of organic EL panels may internally be provided in one housing 17.

[Second Embodiment]

Figure 6:
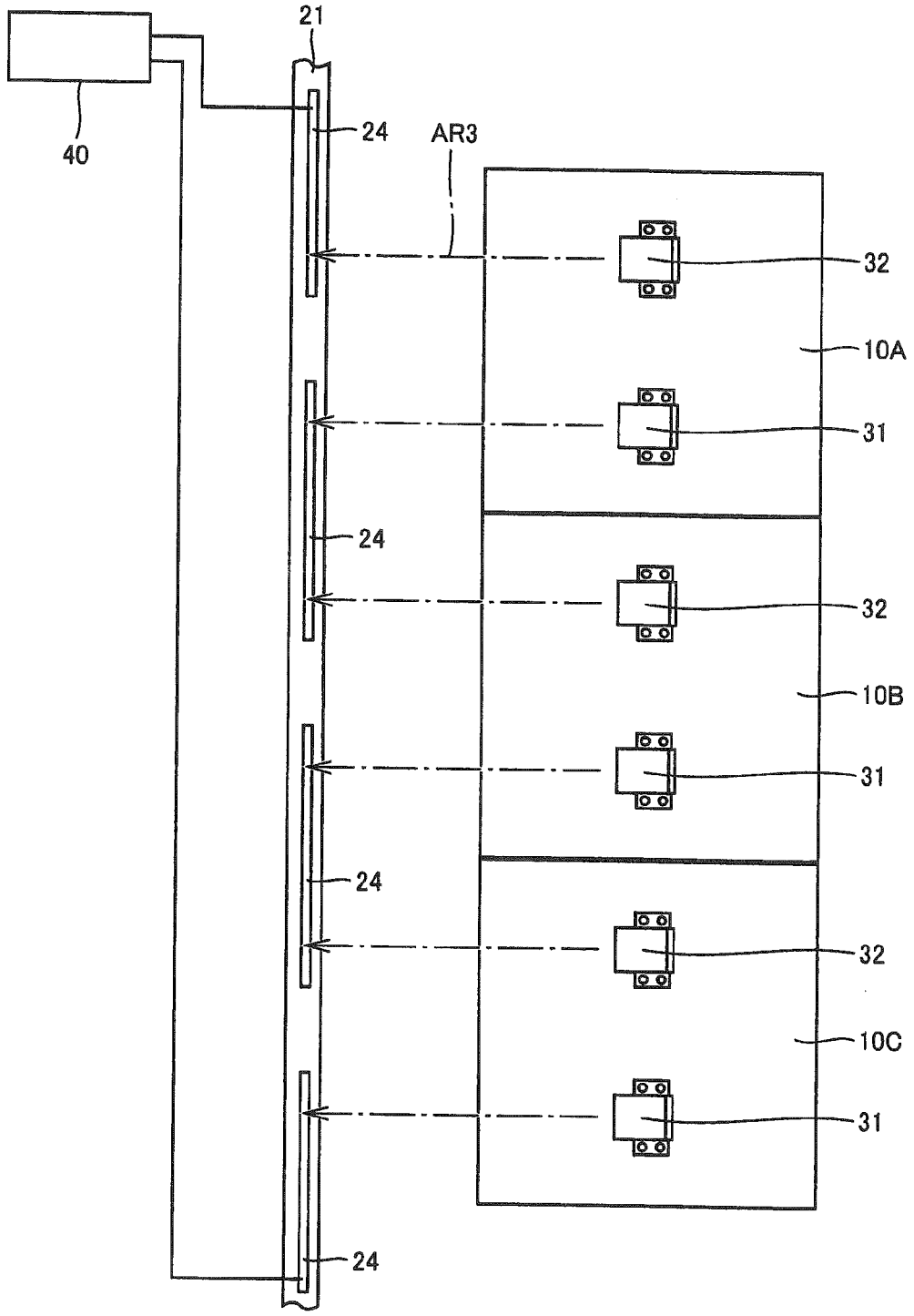
FIG. 6 is a plan view showing a manner that a lighting panel provided in a lighting apparatus in a second embodiment is attached to a holding member.

As shown in FIG. 6, in the present embodiment, lighting panels 10A to 10C and a plurality of other lighting panels (not shown) are arranged to be adjacent to one another. When lighting panels 10A to 10C are attached to holding member 21, each attachment bracket 31, 32 is attached to holding member 21 (see an arrow AR3). On a surface of holding member 21, a plurality of wiring patterns 24 (electric contacts) are provided at a distance from one another. Wiring patterns 24 located at opposing ends among the plurality of wiring patterns are connected to drive circuit 40.

Figure 7:
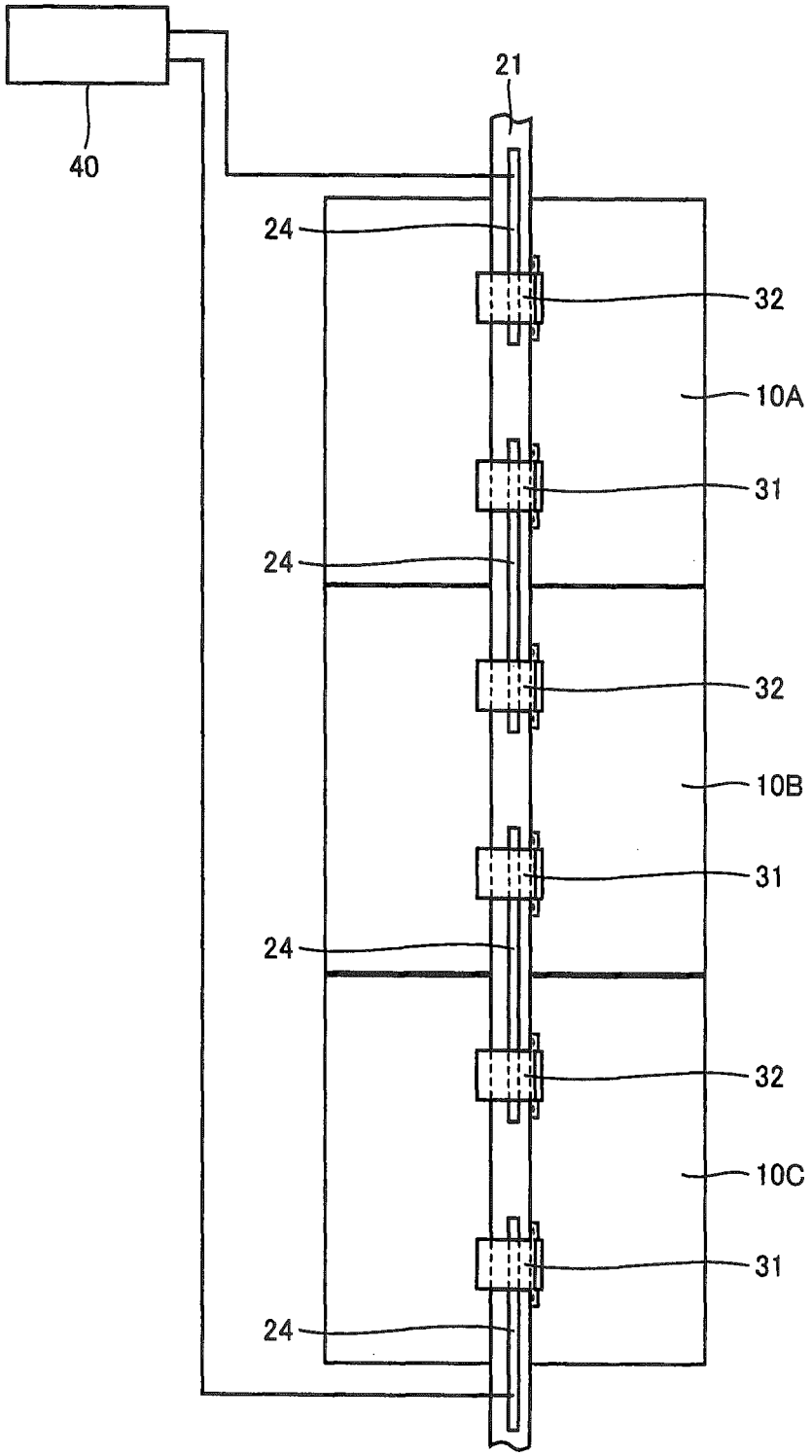
FIG. 7 is a plan view showing the lighting apparatus in the second embodiment.

Referring to FIG. 7, while lighting panels 10A to 10C are attached to holding member 21, attachment bracket 31, 32 and wiring pattern 24 are electrically connected to each other. Wiring patterns 24 connect lighting panels 10A to 10C in series with one another. Therefore, according to the present embodiment, since electrical connection from drive circuit 40 is established at the time point of attachment of lighting panels 10A to 10C to holding member 21, convenience in attachment is high.

[Third Embodiment]

Figure 8:
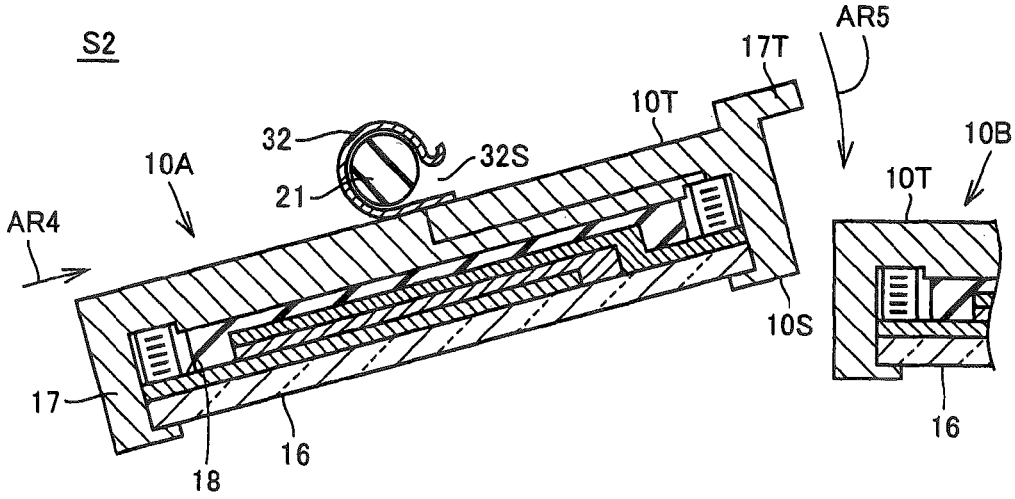
FIG. 8 is a cross-sectional view showing a lighting panel (in a second position) used in a lighting apparatus in a third embodiment.

As shown in FIG. 8, a stopper portion 17T may be provided in an outer periphery of lighting panel 10A on the back surface 10T side. Stopper portion 17T is formed, for example, in a parallelepiped shape and provided to extend outward from back surface 10T of lighting panel 10A.

Lighting panel 10A is attached to holding member 21 (see an arrow AR4) while light-emitting surface 16 forms second position S2 inclined with respect to light-emitting surface 16 of another lighting panel 10B or the like. After lighting panel 10A is attached to holding member 21, it is pivoted such that light-emitting surface 16 is arranged to be on the same plane with light-emitting surface 16 of another lighting panel 10B or the like (see an arrow AR5).

Figure 9:
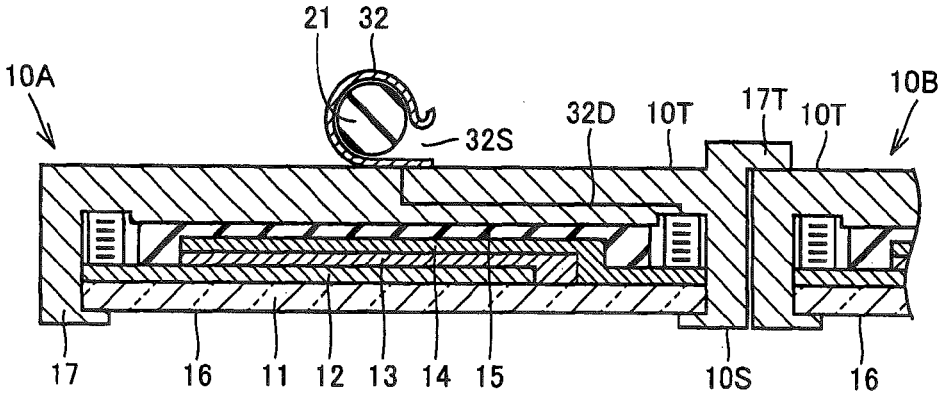
FIG. 9 is a cross-sectional view showing the lighting panel (in a first position) used in the lighting apparatus in the third embodiment.

Referring to FIG. 9, lighting panel 10A forms first position S1 as light-emitting surface 16 is arranged to be on the same plane with light-emitting surface 16 of another lighting panel 10B or the like. When lighting panel 10A makes transition from second position S2 to first position S1 as it pivots, stopper portion 17T comes in contact with back surface 10T of neighboring lighting panel 10B. When lighting panel 10A makes transition from second position S2 to first position S1, an amount of pivot of lighting panel 10A is restricted. Therefore, lighting panel 10A does not excessively pivot and convenience in attachment is high.

[Fourth Embodiment]

Figure 10:
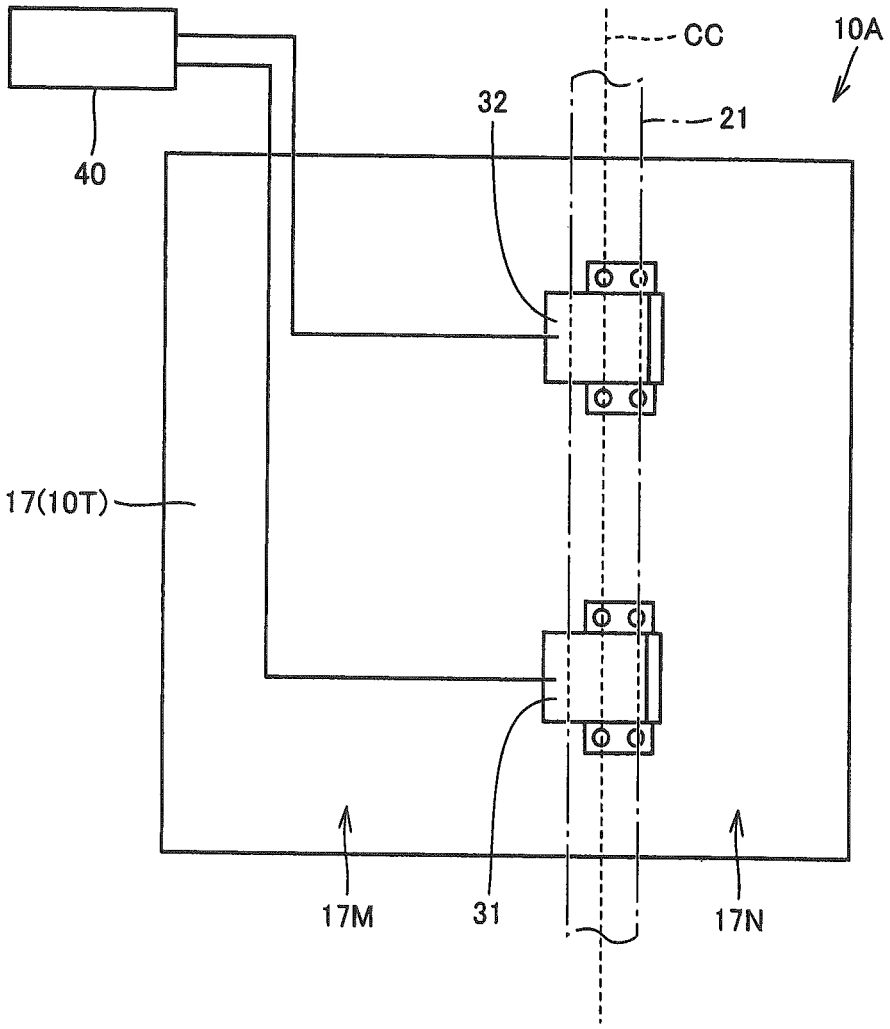
FIG. 10 is a plan view showing a lighting panel used in a lighting apparatus in a fourth embodiment.

As shown in FIG. 10, attachment brackets 31, 32 in the present embodiment are arranged such that one side 17M and the other side 17N are asymmetric with respect to the central axis CC of pivot of lightning panel 10A. The pivot is made with respect to holding member 21. Attachment brackets 31, 32 are arranged such that central axis CC of pivot of lighting panel 10A is closer to a side surface on back surface 10T of lighting panel 10A.

In attachment of lighting panel 10A to holding member 21, if a portion where attachment bracket 31 should essentially be attached to holding member 21 and a portion where attachment bracket 32 should essentially be attached are arranged in a wrong way around (in a reverse orientation), lighting panel 10A interferes with another lighting panel or the like. Lighting panel 10A is attached to holding member 21 only in a proper orientation.

If positive and negative polarities of electricity fed to lighting panel 10A are reversed, a portion of lighting panel 10A forming organic EL may electrically fail. According to lighting panel 10A in the present embodiment, it is attached to holding member 21 only in a proper orientation, and therefore failure of organic EL due to what is called reverse attachment is prevented.

[Fifth Embodiment]

Figure 11:
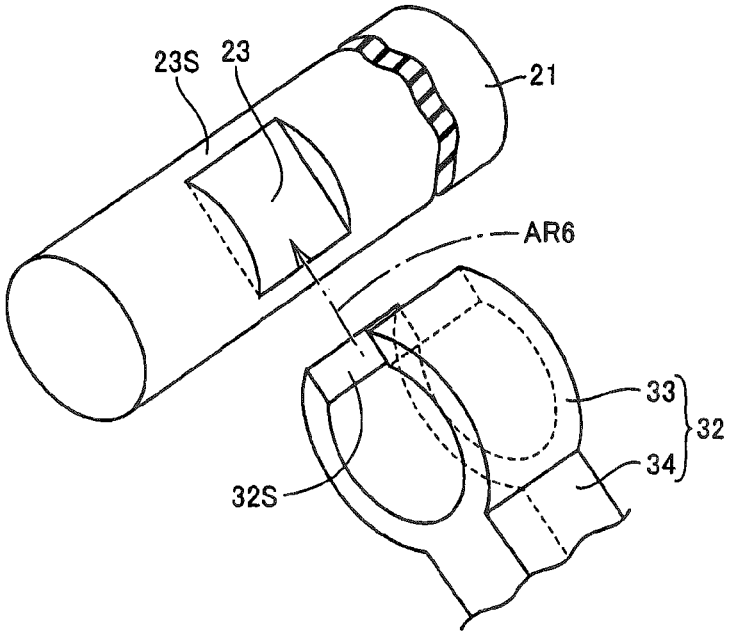
FIG. 11 is a perspective view showing a manner that a lighting panel (an attachment bracket) used in a lighting apparatus in a fifth embodiment is attached to a holding member.
Figure 12:
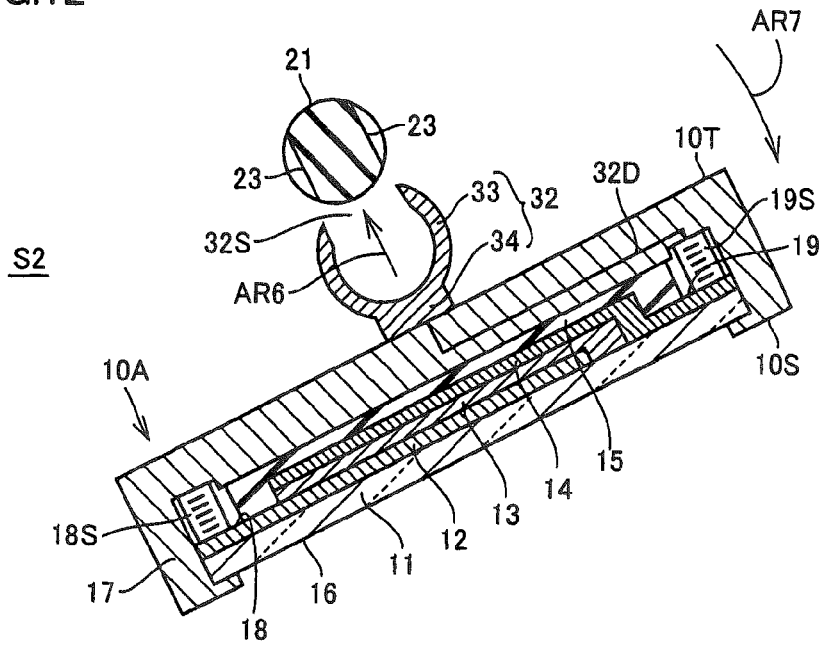
FIG. 12 is a cross-sectional view showing a manner that the lighting panel (in a second position) used in the lighting apparatus in the fifth embodiment is attached to the holding member.

As shown in FIGS. 11 and 12, attachment bracket 32 in the present embodiment is constituted of a grip portion 33 provided with reception portion 32S and a base portion 34 supporting grip portion 33. Grip portion 33 has prescribed rigidity. Grip portion 33 is formed substantially in a C-shape and formed symmetrically with respect to reception portion 32S. Holding member 21 in the present embodiment is provided with a pair of cut surfaces 23 corresponding to a width dimension of reception portion 32S.

As shown in FIG. 12, lighting panel 10A is attached to holding member 21 while it forms second position S2 in which light-emitting surface 16 is inclined with respect to light-emitting surfaces of other lighting panels (not shown) (see an arrow AR6). After lighting panel 10A is attached to holding member 21, it is pivoted such that light-emitting surface 16 is arranged to be on the same plane with the light-emitting surfaces of other lighting panels (see an arrow AR7).

Figure 13:
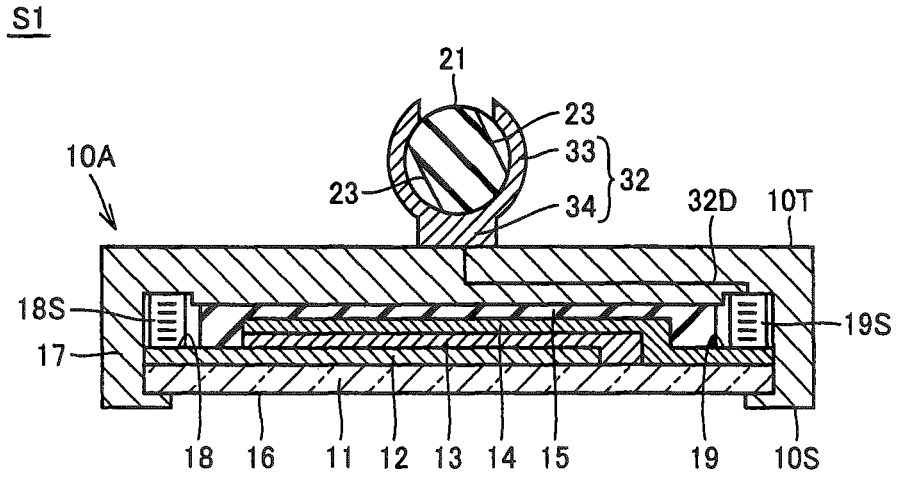
FIG. 13 is a cross-sectional view showing a manner that the lighting panel (in a first position) used in the lighting apparatus in the fifth embodiment has been attached to the holding member.

Referring to FIG. 13, lighting panel 10A forms first position S1 as light-emitting surface 16 is arranged substantially on the same plane with the light-emitting surfaces of other lighting panels (not shown). When lighting panel 10A makes transition from second position S2 to first position S1 as it pivots, grip portion 33 of attachment bracket 32 is engaged with an outer circumferential surface 23S (see FIG. 11) of holding member 21. When lighting panel 10A is removed from holding member 21, operations in a flow reverse to the above are performed. According to the construction in the present embodiment as well, a function and effect the same as in the first embodiment described above can be obtained.

[Sixth Embodiment]

Figure 14:
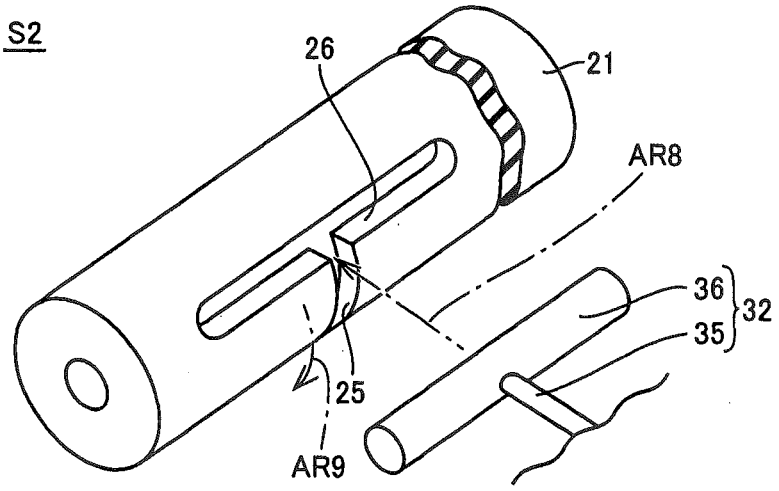
FIG. 14 is a perspective view showing a manner that a lighting panel (an attachment bracket) used in a lighting apparatus in a sixth embodiment is attached to a holding member.

As shown in FIG. 14, attachment bracket 32 in the present embodiment is constructed generally in a T-shape. Attachment bracket 32 is constituted of a support portion 35 formed like a rod and a rod-shaped insertion portion 36 attached to a tip end portion of support portion 35. A lighting panel (not shown) is attached to a rear end portion of support portion 35.

Holding member 21 in the present embodiment is formed in a cylindrical shape. Holding member 21 is provided with a cut 25 and an elongated hole 26. Cut 25 is formed to be slightly greater than a diameter of support portion 35 of attachment bracket 32 and provided to extend in a direction of an outer circumference (a direction of a circumference) of holding member 21. Elongated hole 26 is formed to be slightly greater than a length of insertion portion 36 of attachment bracket 32 and provided to extend in a longitudinal direction of holding member 21.

When a lighting panel (not shown) is attached to holding member 21, insertion portion 36 is inserted in elongated hole 26 while the lighting panel forms the second position (see an arrow AR8). After insertion portion 36 is arranged on an inner circumferential surface side of holding member 21, the lighting panel is pivoted such that support portion 35 enters cut 25 (see an arrow AR9). Insertion portion 36 of attachment bracket 32 and the inner circumferential surface of holding member 21 are engaged with each other, and the lighting panel forms the first position. When the lighting panel is removed from holding member 21, operations in a flow reverse to the above are performed. According to the construction in the present embodiment as well, a function and effect the same as in the first embodiment described above can be obtained.

As can be seen from the plurality of embodiments above, so long as a holding member and an attachment bracket are engaged with each other, any shape and construction of a portion of engagement between the holding member and the attachment bracket is acceptable, and limitation to the shape and the construction described in the plurality of embodiments above is not intended.

Though each embodiment based on the present invention has been described above, each embodiment disclosed herein is illustrative and non-restrictive in every respect. The technical scope of the present invention is defined by the terms of the claims, and is intended to include any modifications within the scope and meaning equivalent to the terms of the claims.

REFERENCE SIGNS LIST

10, 10A, 10A, 10B, 10C, 10D lighting panel; 10S front surface; 10T back surface; 11 transparent substrate; 12 anode; 13 organic layer; 14 cathode; 15 sealing layer; 16 light-emitting surface; 17 housing; 17G extension portion; 17M one side; 17N the other side; 17T stopper portion; 18 anode connection portion; 18S, 19S contact spring; 19 cathode connection portion; 21, 22 holding member; 23 cut surface; 23S outer circumferential surface; 24 wiring pattern; 25 cut; 26 elongated hole; 31, 32 attachment bracket; 32D internal wiring material; 32S reception portion; 33 grip portion; 34 base portion; 35 support portion; 36 insertion portion; 40 drive circuit; 100 lighting apparatus; AR1, AR2, AR3, AR4, AR5, AR6, AR7, AR8, AR9, DR arrow; S1 first position; and S2 second position.

The invention claimed is:

1. A lighting apparatus, comprising:

a first holding member extending in a prescribed direction;

a first plurality of lighting panels, each of the first plurality of lighting panels having a light-emitting surface on a side of a front surface; and wherein each of the first plurality of lighting panels comprises a first attachment bracket provided on a back surface of said lighting panel opposite to the front surface;

wherein each first attachment bracket is structured to detachably couple with the first holding member;

wherein each lighting panel of the first plurality of lighting panels and the respective first attachment brackets are structured such that the lighting panel is pivotable relative to an axis of the first holding member;

the first plurality of lighting panels are arranged to be directly adjacent to each other with substantially no space therebetween;

wherein the first plurality of lighting panels, the first holding member, and the first attachment brackets are structured such that each of the first plurality of lighting panels can be alternated between:

a first position in which the light-emitting surface of the lighting panel is located substantially on a same plane as the light emitting surfaces of the other lighting panels, and a second position in which said lighting panel is inclined with respect to another lighting panel of the first plurality of lighting panels, and the first plurality of lighting panels and the respective first attachment brackets are structured such that, when a lighting panel of the plurality of lighting panels is in the second position, the respective first attachment bracket of the lighting panel in the second position is detachable from the holding member in a direction away from the first holding member.

2. The lighting apparatus according to claim 1, wherein when a lighting panel is in said first position, power is fed from external electric power supply means to said lighting panel, and when a lighting panel is in said second position, power feeding from said external electric power supply means to said lighting panel is stopped.

3. The lighting apparatus according to claim 2, wherein said first holding member comprises a first electric contact structured to feed power from said external electric power supply means to said lighting panel, said first attachment bracket comprises a second electric contact structured to power, when a lighting panel is in said first position, said lighting panel receives power from said external electric power supply means through said first attachment bracket as said second electric contact and said first electric contact of are in contact with each other; and when a lighting panel is in said second position, said power feeding is stopped as said second electric contact and said first electric contact of are not in contact with each other.

4. The lighting apparatus according to claim 2, wherein said first holding member comprises a first electric contact structured to feed power from said external electric power supply means to said lighting panel, each of the plurality of lighting panels comprises a second attachment bracket provided on a back surface of said lighting panel, the first attachment bracket comprises a second electric contact for a positive electrode, and the second attachment bracket comprises a third electric contact for a negative electrode.

5. The lighting apparatus according to claim 4, wherein said first holding member comprises a wire for power feeding from said external electric power supply means to each lighting panel, adjacent lighting panels of the plurality of lighting panels are arranged in series as the third electric contact for a negative electrode of a first lighting panel of the adjacent lighting panels and the second electric contact for a positive electrode of a second lighting panel of the adjacent lighting panels are electrically connected through said wire.

6. The lighting apparatus according to claim 1, further comprising a second holding member arranged in parallel to the first holding member, and a second plurality of lighting panels, each of the second plurality of lighting panels being attached to the second holding member.

7. The lighting apparatus according to claim 6, wherein a stopper portion is provided in an outer periphery of each of said second plurality of lighting panels, and the stopper portions of each lighting panel of the second plurality of lighting panels is structured so as to limit rotation of an adjacent lighting panel of the first plurality of lighting panels when the lighting panel of the first plurality of lighting panels transitions from the second position to the first position.

8. The lighting apparatus according to claim 1, wherein each attachment bracket is arranged is arranged asymmetrically on the back surface of the respective lighting panel with respect to the axis of the first holding member.

9. The lighting apparatus according to claims 1, wherein each lighting panel comprises organic EL.

10. The lighting apparatus according to claim 1, wherein the first attachment brackets have a cross-sectional shape having a discontinuous part in the circumferential direction thereof;

a reception portion structured to receive the first holding member is formed in the discontinuous part;

the first attachment brackets are structured such that a first attachment bracket is released from the first holding member through the respective reception portion when the respective lighting panel is in the second position and is moved in the direction away from the first holding member; and the first attachment brackets are structured to restrict movement of the respective lighting panel in a direction toward the first holding member and a direction away from the first holding member when the respective lighting panel is in the first position.

11. The lighting apparatus according to claim 1, wherein the first holding member is fixed to an installation location of the lighting apparatus.

* * * * *